US006378445B1

(12) United States Patent
Willard, Sr. et al.

(10) Patent No.: US 6,378,445 B1
(45) Date of Patent: Apr. 30, 2002

(54) PORTABLE CHANGING TABLE

(76) Inventors: John W. Willard, Sr.; Susan L. Willard, both of 214 W. Jefferson Dr., Lake Monticello, VA (US) 22936

( * ) Notice: Subject to any disclaimer, the term of this patent is extended or adjusted under 35 U.S.C. 154(b) by 0 days.

(21) Appl. No.: 09/671,897

(22) Filed: Sep. 28, 2000

(51) Int. Cl.[7] ..... A47B 3/00
(52) U.S. Cl. ..... 108/115
(58) Field of Search ..... 108/115, 167, 108/169, 171, 174, 137; 5/947

(56) References Cited

U.S. PATENT DOCUMENTS

| | | | | | |
|---|---|---|---|---|---|
| 2,735,737 | A | * | 2/1956 | Hancock | 5/947 |
| 3,462,773 | A | * | 8/1969 | Triplett | 108/115 X |
| 4,216,951 | A | * | 8/1980 | Griffin | |
| 4,527,830 | A | | 7/1985 | Meyers | |
| D287,318 | S | | 12/1986 | Garduno | |
| 5,062,557 | A | | 11/1991 | Mahvi et al. | |
| 5,299,336 | A | | 4/1994 | Marteeny | |
| 5,615,433 | A | | 4/1997 | Martin | |
| 5,743,649 | A | | 4/1998 | Gonzalez | |
| 6,079,338 | A | * | 6/2000 | Yeh | 108/115 |

* cited by examiner

*Primary Examiner*—Jose V. Chen

(57) ABSTRACT

A portable changing table for providing a table for changing the diaper of an infant. The portable changing table includes a pair of elongate members. Each of the elongate members has a first end and a second end. The elongate members are orientated generally parallel to each other. Each of a pair of leg portions is hingedly coupled to a pair of respective ends of the elongate members such that the leg portions may be selectively moved between a position that abuts the elongate members and a position orientated generally perpendicular to the elongate members. A panel has a pair of lateral edges each being securely attached to one of the elongate members. The lateral edges are attached along their length to the elongate members and generally extend between the first and second ends of the elongate members.

8 Claims, 3 Drawing Sheets

PORTABLE CHANGING TABLE

BACKGROUND OF THE INVENTION

1. Field of the Invention

The present invention relates to changing tables and more particularly pertains to a new portable changing table for providing a table for changing the diaper of an infant.

2. Description of the Prior Art

The use of changing tables is known in the prior art. More specifically, changing tables heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,743,649; 5,615,433; 5,299,336; 4,527,830; 5,062,557; and 287,318.

While these devices fulfill their respective, particular objectives and requirements, the aforementioned patents do not disclose a new portable changing table. The inventive device includes a pair of elongate members. Each of the elongate members has a first end and a second end. The elongate members are orientated generally parallel to each other. Each of a pair of leg portions is hingedly coupled to a pair of respective ends of the elongate members such that the leg portions may be selectively moved between a position that abuts the elongate members and a position orientated generally perpendicular to the elongate members. A panel has a pair of lateral edges each being securely attached to one of the elongate members. The lateral edges are attached along their length to the elongate members and generally extend between the first and second ends of the elongate members.

In these respects, the portable changing table according to the present invention substantially departs from the conventional concepts and designs of the prior art, and in so doing provides an apparatus primarily developed for the purpose of providing a table for changing the diaper of an infant.

SUMMARY OF THE INVENTION

In view of the foregoing disadvantages inherent in the known types of changing tables now present in the prior art, the present invention provides a new portable changing table construction wherein the same can be utilized for providing a table for changing the diaper of an infant.

The general purpose of the present invention, which will be described subsequently in greater detail, is to provide a new portable changing table apparatus and method which has many of the advantages of the changing tables mentioned heretofore and many novel features that result in a new portable changing table which is not anticipated, rendered obvious, suggested, or even implied by any of the prior art changing tables, either alone or in any combination thereof.

To attain this, the present invention generally comprises a pair of elongate members. Each of the elongate members has a first end and a second end. The elongate members are orientated generally parallel to each other. Each of a pair of leg portions is hingedly coupled to a pair of respective ends of the elongate members such that the leg portions may be selectively moved between a position that abuts the elongate members and a position orientated generally perpendicular to the elongate members. A panel has a pair of lateral edges each being securely attached to one of the elongate members. The lateral edges are attached along their length to the elongate members and generally extend between the first and second ends of the elongate members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable changing table apparatus and method which has many of the advantages of the changing tables mentioned heretofore and many novel features that result in a new portable changing table which is not anticipated, rendered obvious, suggested, or even implied by any of the prior art changing tables, either alone or in any combination thereof.

It is another object of the present invention to provide a new portable changing table which may be easily and efficiently manufactured and marketed.

It is a further object of the present invention to provide a new portable changing table which is of a durable and reliable construction.

An even further object of the present invention is to provide a new portable changing table which is susceptible of a low cost of manufacture with regard to both materials and labor, and which accordingly is then susceptible of low prices of sale to the consuming public, thereby making such portable changing table economically available to the buying public.

Still yet another object of the present invention is to provide a new portable changing table which provides in the apparatuses and methods of the prior art some of the advantages thereof, while simultaneously overcoming some of the disadvantages normally associated therewith.

Still another object of the present invention is to provide a new portable changing table for providing a table for changing the diaper of an infant.

Yet another object of the present invention is to provide a new portable changing table which includes a pair of elongate members. Each of the elongate members has a first end and a second end. The elongate members are orientated generally parallel to each other. Each of a pair of leg portions is hingedly coupled to a pair of respective ends of the elongate members such that the leg portions may be selectively moved between a position that abuts the elongate members and a position orientated generally perpendicular to the elongate members. A panel has a pair of lateral edges each being securely attached to one of the elongate members. The lateral edges are attached along their length to the elongate members and generally extend between the first and second ends of the elongate members.

Still yet another object of the present invention is to provide a new portable changing table that is easily carried and stored to provide a convenient changing table wherever needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
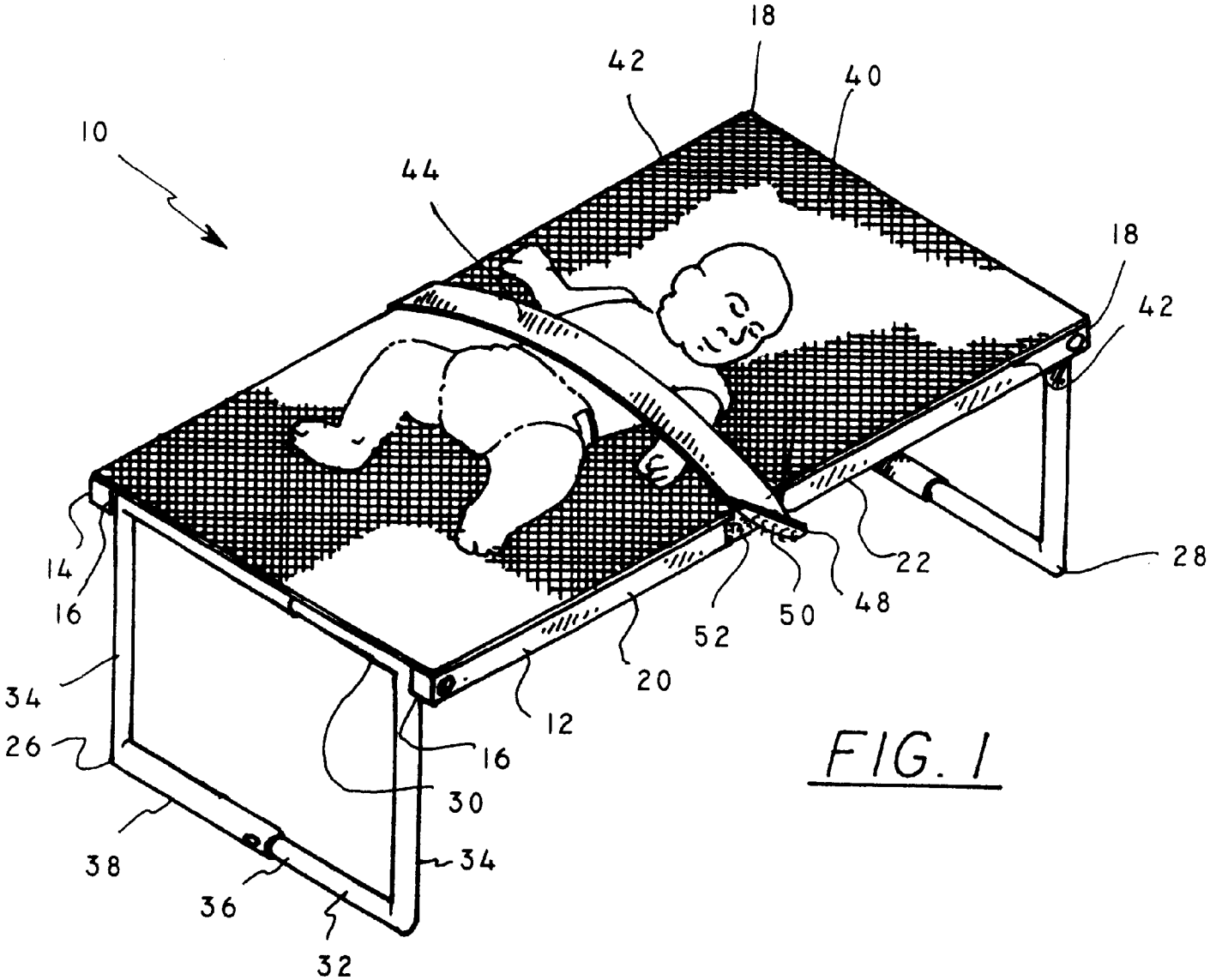
FIG. 1 is a schematic perspective view of a new portable changing table according to the present invention.

With reference now to the drawings, and in particular to FIGS. 1 through 5 thereof, a new portable changing table embodying the principles and concepts of the present invention and generally designated by the reference numeral 10 will be described.

As best illustrated in FIGS. 1 through 5, the portable changing table 10 generally comprises a pair of elongate members 12, 14. Each of the elongate members 12, 14 has a first end 16 and a second end 18. The elongate members 12, 14 each have a break therein such that a first portion 20 and a second portion 22 are defined. Each of first 20 and second 22 portions is hingedly coupled together by a hinging means 24 such that each of the elongate members 12, 14 may be selectively moved between a folded position and a generally linear position. The elongate members 12, 14 are orientated generally parallel to each other.

Each of a pair of leg portions 26, 28 comprises a frame having a top bar 30, a bottom bar 32 and a pair of side bars 34. Each of the leg portions 26, 28 is hingedly coupled to a pair of respective ends of the elongate members 12, 14 such that the leg portions 26, 28 may be selectively moved between a position that abuts the elongate members and a position orientated generally perpendicular to the elongate members. Each of the side bars 34 are hingedly coupled to one of the elongate members 12, 14 such that the top bars 30 are generally adjacent to the elongate members. Each of the top 30 and bottom 32 bars is telescoping bars such that each has a first portion 36 slidably extendable into a second portion 38. This allows a user to change the distance between the elongate members 12, 14 for easier storage.

A panel 40 has a pair of lateral edges 42. Each of the lateral edges 42 is securely attached to one of the elongate members 12, 14. The lateral edges 42 are attached along their length to the elongate members and generally extend between the first 16 and second 18 ends of the elongate members 12, 14. The panel 40 comprises a generally flexible material which is ideally a cloth mesh material.

A strap member 44 has a first end 46 and a second end 48. The first end 46 of the strap member is securely attached to a first 12 of the elongate members. A fastening means removably fastens the second end 48 of the strap member 44 to a second 14 of the elongate members. The fastening means comprises a hook and loop fastening means. A loop portion 50 is securely attached to the strap member 44 and is positioned generally adjacent to the second end 48. A hook portion 52 is securely attached to the second elongate member 14.

Ideally, a plurality of covering members 54 is included. The covering members 54 are disposable paper material coverings which may be positioned on a top surface of the panel 40 for sterilization reasons.

A container means 56 for storing and carrying the device is preferably included. The container 56 comprises a bag having an open side. The bag has a plurality of compartments 58 therein. At least one of the compartments has a size adapted for holding the table device 10 therein when the table device is folded. The container 56 means preferably has a pair of carrying straps 60 coupled thereto.

Figure 2:
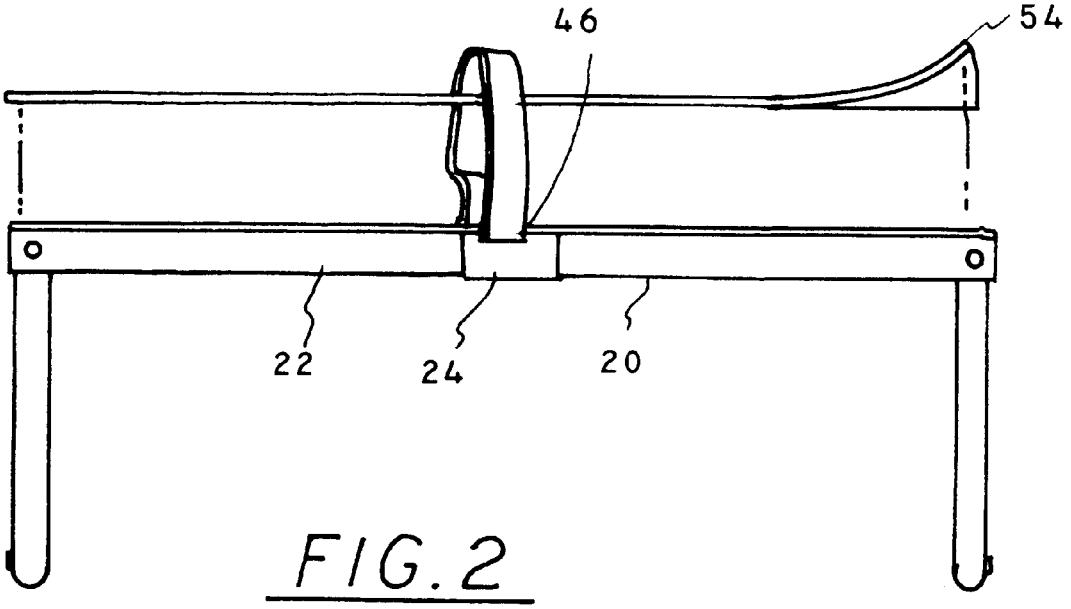
FIG. 2 is a schematic side view of the present invention.
Figure 3:
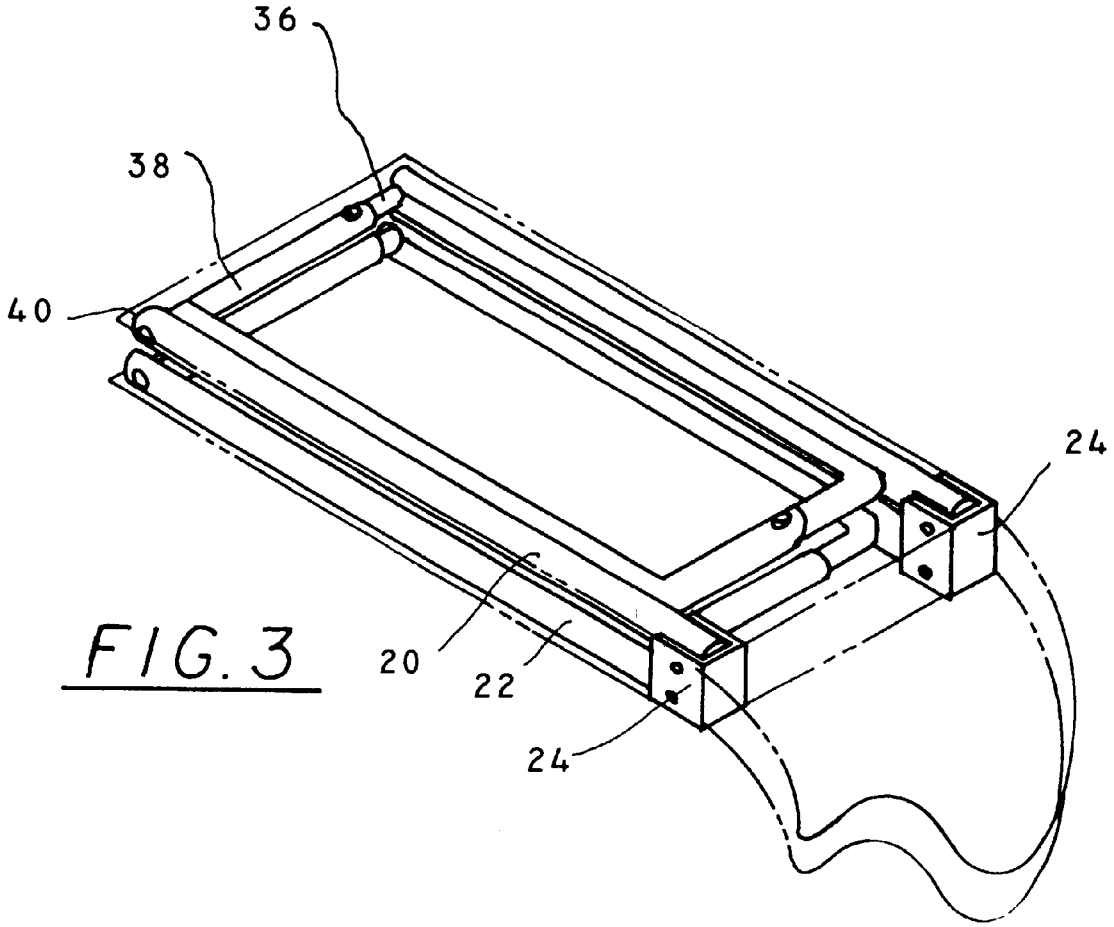
FIG. 3 is a schematic perspective view of the present invention.
Figure 4:
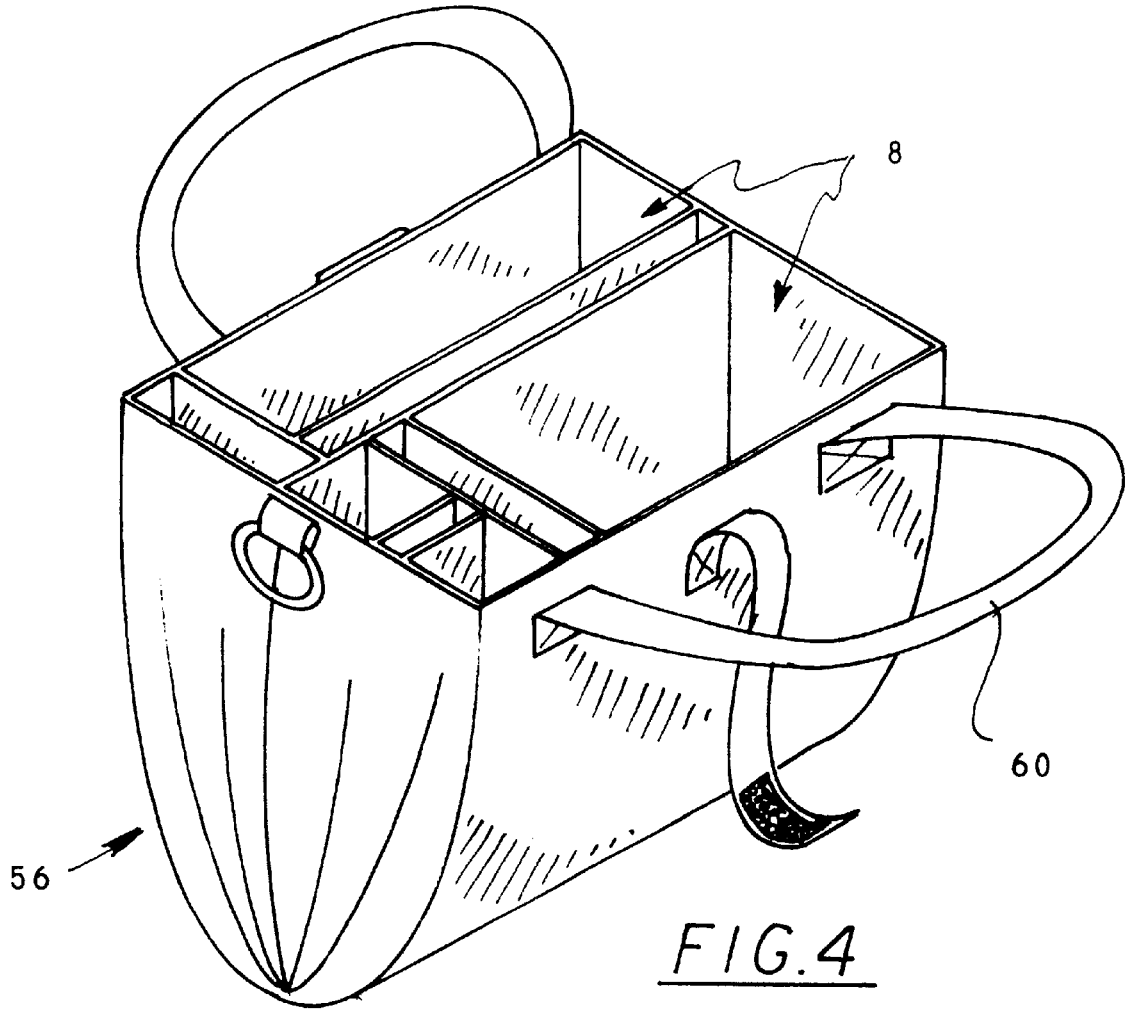
FIG. 4 is a schematic perspective view of the carrying means of the present invention.
Figure 5:
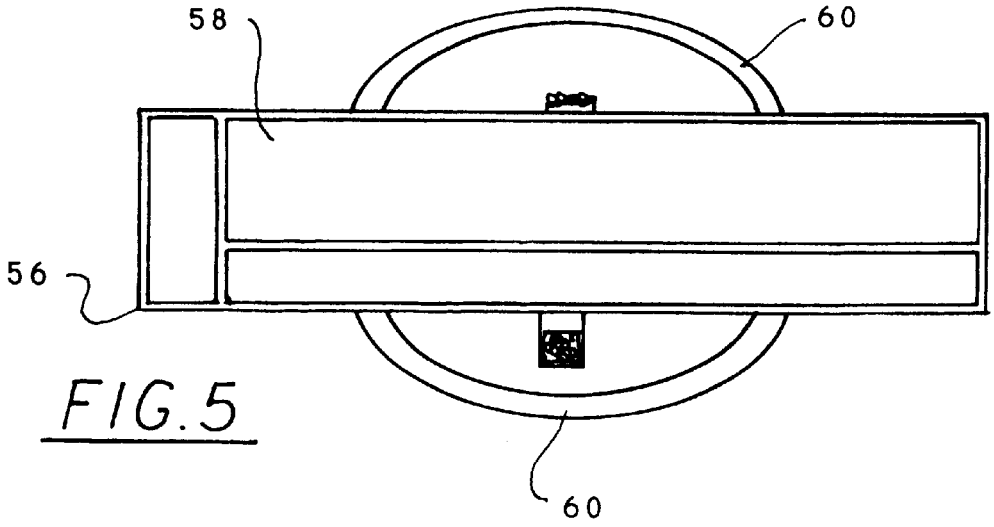
FIG. 5 is a schematic top view of FIG. 4 the present invention.

In use, the first 36 and second 38 portions of the top 30 and bottom 32 bars are extended to move the elongate members apart. The elongate members 12, 14 are moved into a linear orientation and the leg portions 26 moved downward as shown in FIG. 2. The baby is placed upon the panel 40 and the diaper changed. When finished, the first 36 and second 38 portions are pushed together, the leg portions are folded against the elongate members and the elongate members 12, 14 are folded as shown in FIG. 3. The strap member 44, for holding the infant steady, may also be used as carrying strap or the table device may be placed in the container means 56.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable changing table device, said device comprising:

a pair of elongate members, each of said elongate members having a first end and a second end, said elongate members being orientated generally parallel to each other;

a pair of leg portions, each of said leg portions being hingedly coupled to a pair of respective ends of said elongate members such that said leg portions may be selectively moved between a position abutting said elongate members and a position orientated generally perpendicular to said elongate members, each of said leg portions comprising a frame having a top bar, a bottom bar and a pair of side bars, wherein each of said side bars is hingedly coupled to one of said elongate members, each of said top and bottom bars being telescoping bars such that each has a first portion slidably extendable into a second portion; and a panel having a pair of lateral edges, each of said lateral edges being securely attached to one of said elongate members, said lateral edges being attached along their length to said elongate members and generally extending between said first and second ends of said elongate members.

2. The portable changing table device as in claim 1, wherein each of said elongate members has a break therein such that a first portion and a second portion are defined, each of first and second portions being hingedly coupled together by a hinging means such that each of said elongate members may be selectively moved between a folded position and a generally linear position.

3. The portable changing table device as in claim 1, wherein said panel comprises a generally flexible material.

4. The portable changing table device as in claim 3, wherein said generally flexible material comprises a cloth mesh material.

5. The portable changing table device as in claim 3, further including a strap member having a first end and a second end, said first end of said strap member being securely attached to a first of said elongate members, a fastening means for removably fastening said second end of said strap member to a second of said elongate members.

6. The portable changing table device as in claim 1, further including a covering member comprising a paper material, wherein said covering member may be positioned on a top surface of said panel.

7. The portable changing table device as in claim 1, further including a strap member having a first end and a second end, said first end of said strap member being securely attached to a first of said elongate members, a fastening means for removably fastening said second end of said strap member to a second of said elongate members.

8. A portable changing table device, said device comprising:

a pair of elongate members, each of said elongate members having a first end and a second end, each of said elongate members having a break therein such that a first portion and a second portion are defined, each of first and second portions being hingedly coupled together by a hinging means such that each of said elongate members may be selectively moved between a folded position and a generally linear position, said elongate members being orientated generally parallel to each other;

a pair of leg portions, each of said leg portions comprising a frame having a top bar, a bottom bar and a pair of side bars, each of said leg portions being hingedly coupled to a pair of respective ends of said elongate members such that said leg portions may be selectively moved between a position abutting said elongate members and a position orientated generally perpendicular to said elongate members, each of said side bars being hingedly coupled to one of said elongate members such that said top bars are generally adjacent to said elongate members, each of said top and bottom bars being telescoping bars such that each has a first portion slidably extendable into a second portion;

a panel, said panel having a pair of lateral edges, each of said lateral edges being securely attached to one of said elongate members, said lateral edges being attached along their length to said elongate members and generally extending between said first and second ends of said elongate members, said panel comprising a generally flexible material, said panel comprising a cloth mesh material;

a strap member, said strap member having a first end and a second end, said first end of said strap member being securely attached to a first of said elongate members, a fastening means for removably fastening said second end of said strap member to a second of said elongate members, said fastening means comprising a hook and loop fastening means, a loop portion being securely attached to said strap member and positioned generally adjacent to said second end, a hook portion being securely attached to said second elongate member; and a container means for storing and carrying said device, said container comprising a bag having an open side, said bag having a plurality of compartments therein.

* * * * *